United States Patent [19]

Jorgensen et al.

[11] 4,330,260

[45] May 18, 1982

[54] METHOD AND APPARATUS FOR REGULATING THE COMBUSTION IN A FURNACE

[76] Inventors: Lars L. S. Jorgensen, Ligustervej 1; Ernst V. Jorgensen, Hyrdedamsvej 23; John H. Petersen, Birgittevej 30, all of DK-8220 Brabrand, Denmark

[21] Appl. No.: 8,686

[22] Filed: Jan. 31, 1979

[51] Int. Cl.[3] ..... F23N 00/00

[52] U.S. Cl. ..... 431/12; 431/76

[58] Field of Search ..... 431/12, 76; 236/15 E

[56] References Cited

U.S. PATENT DOCUMENTS

| | | | |
|---|---|---|---|
| 1,482,125 | 1/1924 | Gaster . | |
| 1,709,042 | 4/1929 | Siebert . | |
| 1,764,715 | 6/1930 | Dow . | |
| 1,770,489 | 7/1930 | Loffler . | |
| 1,841,587 | 1/1932 | Finn | 431/76 |
| 2,407,838 | 9/1946 | Kliever | 88/14 |
| 2,608,351 | 8/1952 | Smoot | 236/14 |
| 3,074,644 | 1/1963 | Geniesse | 236/15 |
| 3,404,836 | 10/1968 | Hickam | 236/15 |
| 3,607,117 | 9/1971 | Shaw | 431/12 |
| 3,723,047 | 3/1973 | Baudelet de Livois | 431/76 |
| 3,828,237 | 8/1974 | Ko et al. | 318/619 |
| 3,960,320 | 6/1976 | Slater | 236/15 |
| 3,973,898 | 8/1976 | Seider | 431/76 |
| 4,033,712 | 7/1977 | Morton | 431/12 |
| 4,043,743 | 8/1977 | Seider | 431/76 |
| 4,116,612 | 9/1978 | Melgaard | 431/76 |
| 4,162,889 | 7/1979 | Shigemura | 431/76 |

FOREIGN PATENT DOCUMENTS

| | | |
|---|---|---|
| 83322 | 7/1930 | Denmark . |
| 164242 | 12/1903 | Fed. Rep. of Germany . |
| 348489 | 2/1922 | Fed. Rep. of Germany . |
| 490291 | 1/1930 | Fed. Rep. of Germany . |
| 1010226 | 1/1930 | Fed. Rep. of Germany . |
| 2745459 | 6/1978 | Fed. Rep. of Germany . |
| 676430 | 11/1929 | France . |

*Primary Examiner*—Joseph Man-Fu Moy
*Attorney, Agent, or Firm*—Kenyon & Kenyon

[57] ABSTRACT

An apparatus and method for controlling combustion in a furnace is described. The flue gas content is monitored to determine the oxygen and/or carbon dioxide components therein to provide a control signal which is compared with a control signal from a fuel flow sensor to provide an infinitely variable speed control for a blower which supplies combustion air to the furnace being controlled. The speed of the blower is varied in accordance with the flue gas content and the fuel flow rate to provide a continuously variable blower speed to at all times effect optimum combustion efficiency.

12 Claims, 7 Drawing Figures

FIG-1
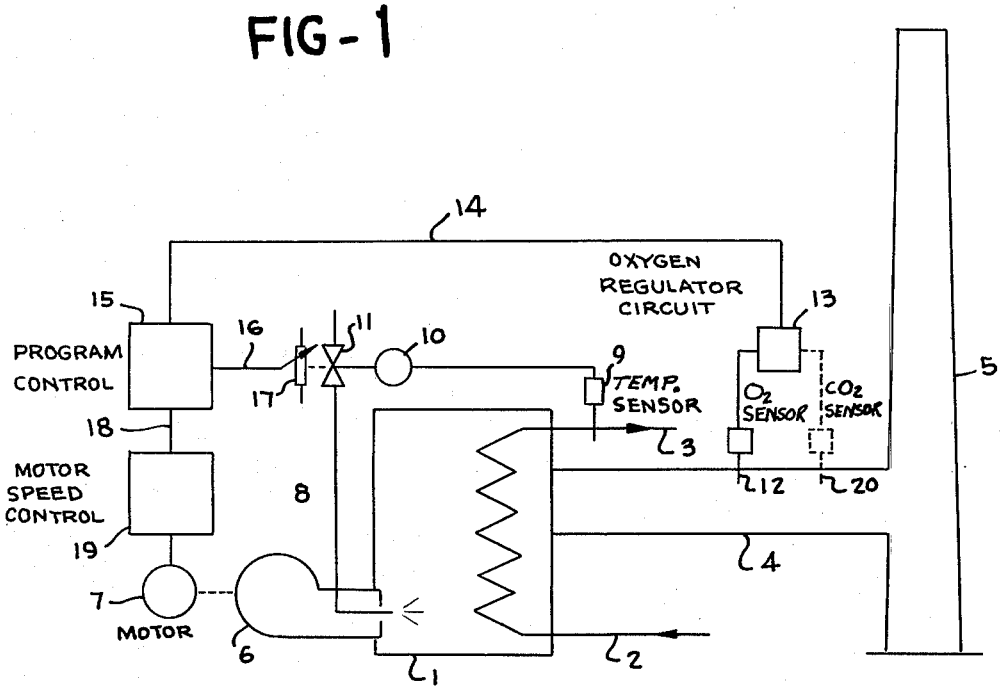
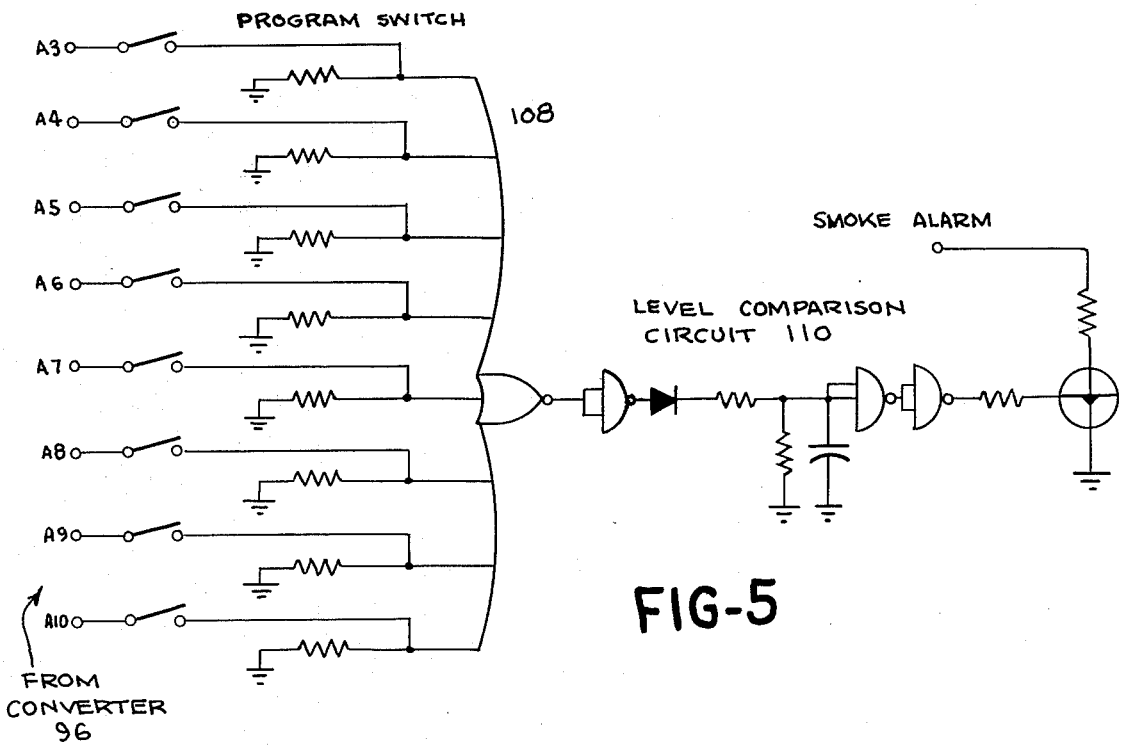
FIG-5

Vcc
LED
O2-
2xBC 238
Vss
O2+
SAMPLE HOLD
A4 x1
OUTPUT TO SUMMATION AMPLIFIER
A5
HIIA2
BC 238
A3x1
CD 4081
LOGIC CIRCUIT
A6
ADJUSTABLE MULTIBRATOR
A2 COMP
A1 x1
+REG
-REG
Vee
FROM ANALYSIS UNIT 13
FROM SMOKE DETECTOR
"1" = STOP

METHOD AND APPARATUS FOR REGULATING THE COMBUSTION IN A FURNACE

BACKGROUND OF THE INVENTION

This invention relates to a method and apparatus for regulating combustion in a furnace or the like which is supplied with combustion air by means of a fan or blower and wherein the fuel supply is regulated according to the load.

It is well-known that in furnaces or boilers operating under varying load conditions the combustion air supply thereto can be controlled by dampers or the like which are adjustable. Moreover, in the case of oil burners it is the normal practice to supply air to an atomizing zone by means of a fan which is driven by an electric motor running at a constant number of revolutions per minute irrespective of the load and therefore irrespective of the amount of fuel supplied. The same is true in furnaces using other fuels, i.e., the combustion air is supplied by an essentially constant speed blower. Under these circumstances the amount of electricity consumed by the blower will be constant and independent of the load. The consumption of electricity will thus be unnecessarily large at low loads, and it is to be noted that in these prior art systems no allowance has been made for variation in the caloric value of the fuel or the pressure and temperature conditions of the air.

Another known technique for combustion control utilizes a step-wise form of regulation of the rotational speed of the blower to control the amount of combustion air being supplied. When this technique is used, the actual variation of the blower speed generally lags a change in condition by a significant amount of time, and in fact, the lag may be so great the the change in blower speed does not truly correlate with the current operating conditions. That is, another change in operating condition may have occurred by the time a change in blower speed is effected to correspond with a preceding change in operating condition. Thus, it is not at all unusual in this type of combustion control system for the adjustment of the blower speed not to correlate with the current actual operating conditions.

Another prior art technique is found in German Pat. No. 490,291; this technique contemplates providing an infinitely variable adjustment for a blower and a fuel pump so that the amount of air and fuel supply to the furnace correspond with varying load conditions. Quite clearly, this technique is far superior to the aforementioned means for combustion control insofar as there can be a relatively high degree of operating efficiency at various stages. However, it is important to note that in this system the air supply is neither corrected according to specific air conditions nor for the caloric value of the fuel being used. When there are changes in the latter conditions, the actual operating conditions can be far different from the optimum. In employing this particular technique there is a risk that although the furnace is operating properly, it at all times will be wrongly adjusted for all load conditions, because the actual conditions of fuel and combustion air are being ignored. For example, this can happen if the atmospheric pressure is unusually low.

It is, therefore, an object of this invention to provide a means and method for controlling the combustion in a furnace by controlling the supply of combustion air to the furnace by means of an infinitely variable adjustment of the rotational speed and/or fan blade angle of a blower which adjustment takes into consideration the actual condition of the fuel and air being supplied to the furnace.

Another object of the invention is to provide a means and method by which the rotational speed of a blower supplying combustion air to a furnace is controlled in accordance with the oxygen or carbon dioxide content of flue exhaust gasses and wherein the aforesaid blower speed continuously bears the prescribed relationship to the current condition of the flue gasses.

Still another object of the invention is to provide a means and method for regulating combustion in a furnace wherein the rotational speed of a blower supplying combustion air to the furnace is additionally controlled in accordance with the pressure and temperature conditions of the air being supplied as combustion air and the caloric values of the fuel being used.

A further object of the invention is to provide means and method for controlling the combustion in a furnace wherein the rotational speed of a blower supplying combustion air to the furnace is controlled to bear a prescribed relationship to the amount of fuel currently being supplied, and wherein the current rotational speed of the blower bears the prescribed relationship on a continuous basis.

An additional object of the invention is to provide a means and method for regulating the combustion in a furnace wherein the oxygen or carbon dioxide content of flue exhaust gases are continuously measured and wherein the amount of fuel supplied to the furnace is being continuously measured and wherein the rotational speed of a blower supplying combustion air to the furnace is continuously adjusted on the basis of the continuous measurements of flue gases and fuel.

Another object of the invention is to provide a primarily electronic apparatus for regulating the combustion in a furnace which meets the foregoing objects while rapidly providing the continuous, infinite variations described hereinabove.

SUMMARY OF THE INVENTION

In accordance with the principles of the invention, the foregoing and other objects are achieved by a means and method wherein combustion is regulated in a furnace by continuously varying the rotational speed of a blower in accordance with a prescribed relationship between flue gas oxygen or carbon dioxide content, the amount and caloric value of the fuel being supplied and the blower speed. Optimum combustion conditions are continuously produced by continually measuring flue gas content and fuel supply and continuously varying blower speed in accordance with the results of those measurements.

A programmed control apparatus is provided which relates the flue gas content and fuel flow in a prescribed relationship to adjust a motor speed control operating a fan motor in a blower system for supplying combustion air. The programmed control device is adapted to take into consideration the characteristics of the fan as well as the resistance to flow in the furnace, outlet pipe and chimney. This results in controlling the blower speed so that it bears a direct relationship to the load being experienced by the furnace. Accordingly, only that amount of electricity is being consumed in operating the blower as is absolutely necessary, and optimum combustion conditions are maintained regardless of fuel and air conditions.

BRIEF DESCRIPTION OF THE DRAWINGS

The principles of the invention will be more readily understood by reference to the description of preferred embodiments given hereinbelow in conjunction with the drawings illustrating those embodiments which are briefly described as follows:

FIG. 1 is a block-schematic diagram illustrating a furnace system utilizing a regulating apparatus constructed according to the principles of the invention;

FIG. 5 is a detailed schematic diagram of a smoke alarm portion of the FIG. 4 embodiment.

DETAILED DESCRIPTION OF THE PREFERRED EMBODIMENT

Figure 2A:
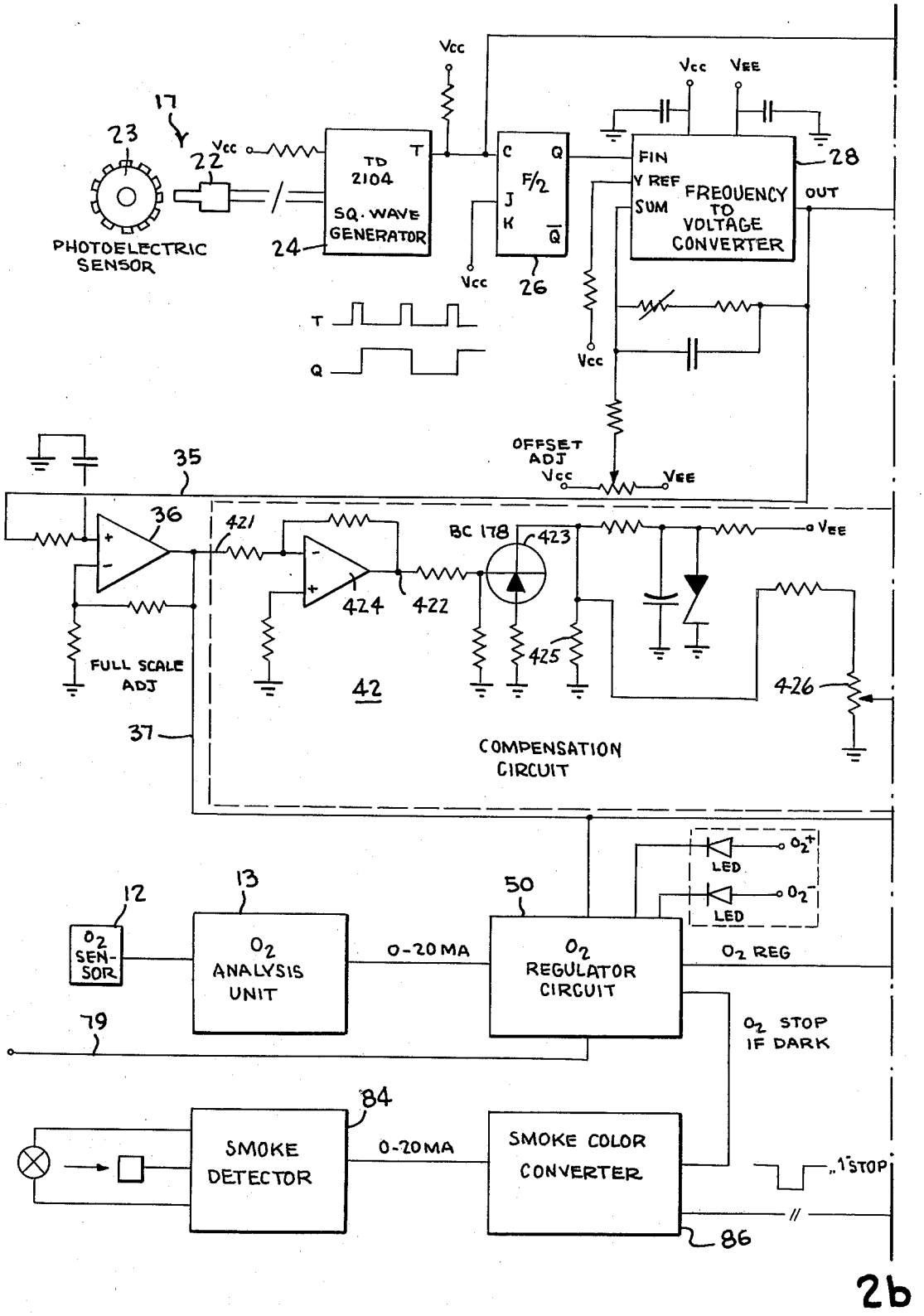
FIG. 2*a* and *b*, viewed together, are detailed schematic diagram of the program control apparatus 15 in the FIG. 1 embodiment along with variations in the fuel and air sensing arrangements illustrated in FIG. 1.

FIG. 1 schematically illustrates a complete furnace system utilizing a combustion regulation apparatus constructed according to the principles of the invention. A boiler 1 is provided for heating water which is supplied through a pipe 2 and discharged from the boiler through a pipe 3. Outlet pipe 4 connects boiler 1 to a chimney 5 so that the exhaust flue gasses are communicated from the boiler through the outlet pipe to the chimney. Combustion air is supplied to the boiler by means of a blower assembly constituted by fan 6 driven by motor 7.

Fuel, in this case, oil, is supplied to the combustion chamber of the furnace through a fuel pipe 8. The amount of fuel supplied is controlled automatically in accordance with known principles by means of a temperature sensor 9 placed in water outlet pipe 3. The temperature sensor controls a motor 10 which adjusts a fuel valve 11 in the pipe 8. Thus, the amount of fuel supplied to the furnace bears a direct relationship to the load being experienced by the furnace. As stated, this principle of controlling fuel flow in accordance with load is known.

A conventional oxygen sensor 12 placed in exhaust gas outlet pipe 4 measures the oxygen content in the flue exhaust gasses. An oxyen analysis unit 13, also of conventional construction, supplies an electrical signal having a current value in accordance with the sensed oxygen content of the output of sensor 12. Oxygen analysis unit 13 may be of the type identified as Taylor Servomex, produced by Sybion Corporation, Crowborough, Sussex, England. The signal from oxygen analysis unit 13 is transmitted through a lead 14 to a program control device 15, which will be described in greater detail herein below. Concurrently, this program control device receives through a lead 16 from a transducer 17 a signal indicating the position of a fuel valve 11. In the case of this embodiment, the current adjustment of fuel valve 11 is sensed by a linear or rotatable potentiometer 17 which provides an electrical signal accordingly. Another form of sensing fuel flow will be described hereinbelow in connection with FIG. 2.

On the basis of the data, so received, and the prescribed program therein contained, program control unit 15 provides a control signal through a wire 18 to a motor speed control unit 19 which is designed to control the rotational speed of fan motor 7. Instead of oxygen content sensor 12 described hereinabove, a sensor for carbon dioxide may be used providing a signal to a unit similar to oxygen analysis unit 13 but which is designed to operate on the basis of carbon dioxide content of the flue gasses. The amount of carbon dioxide in the flue gas bears a direct relationship to the oxygen content so that the same measurement is in effect provided.

Figure 2B:
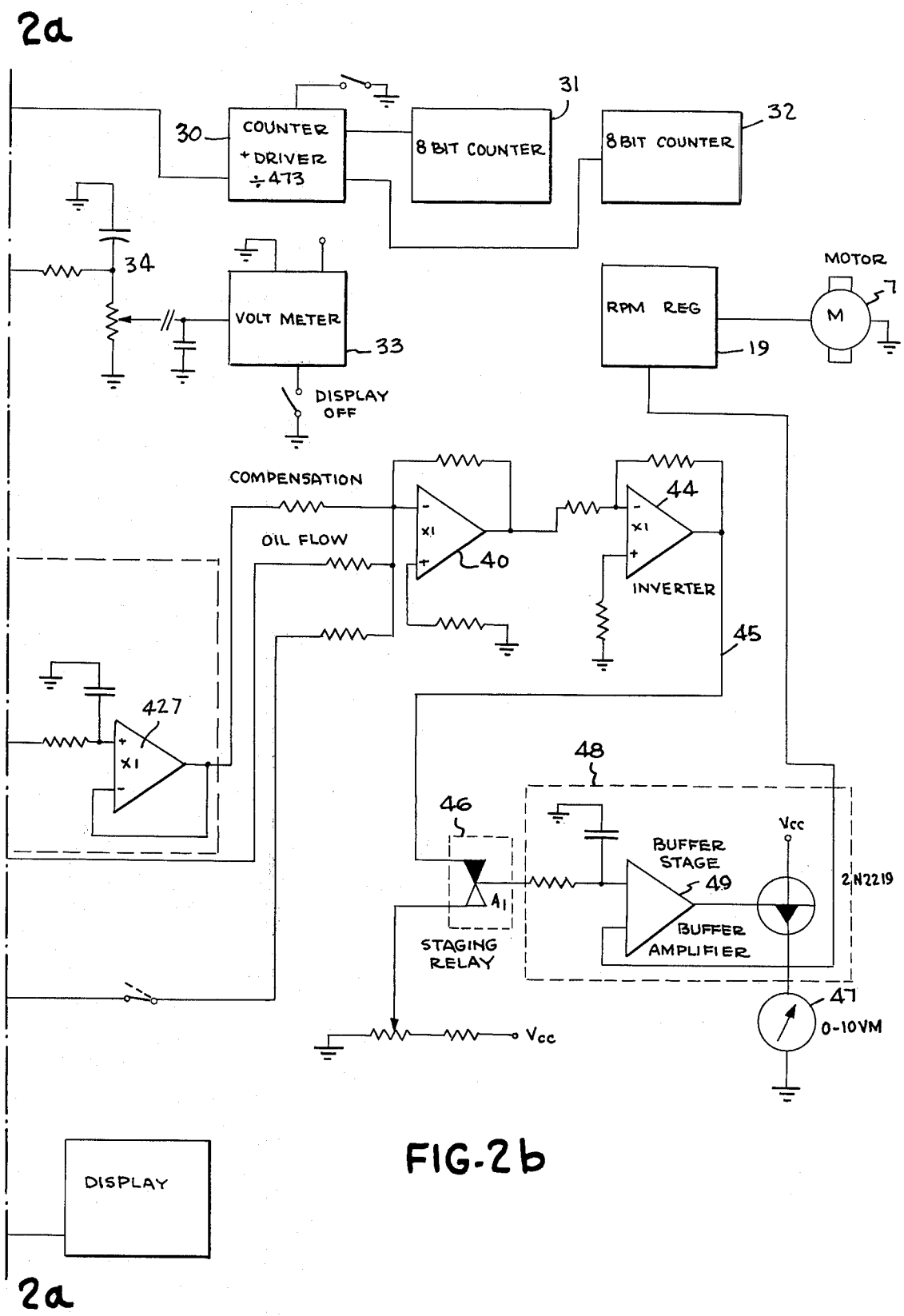

FIG. 2 is constituted by FIGS. 2*a* and 2*b* which must be viewed together with FIG. 2*a* on the left; this Figure illustrates in greater detail the construction and operation of a preferred embodiment of program control unit 15 along with its relationship to oxygen sensor 12 and fuel flow sensor 17.

As stated hereinabove, the fan motor 7, which operates a fan to supply combustion air to the furnace, is controlled by means of a motor speed control unit 19 of known construction. This description is concerned with the means and method by which a regulating signal is derived for operating the motor speed control, said signal having a correlation with the amount of oil flow to the furnace and to the oxygen content of the exhaust gas from the furnace. The regulating signal to the motor speed control unit continuously varies in accordance with variations of the foregoing parameters to thereby vary the rotational speed of fan motor 7 in accordance with variations of the latter parameters.

In this FIG. 2 embodiment, fuel flow sensor 17 is shown to be constitued by a photoelectric sensor 22 which senses the motion of a calibrated wheel 23, the rotational velocity of which is a function of the rate of fuel flow. Alternatively, inductive sensors of known construction may be used. Thus, the photoelectric sensor 22 generates a signal having a frequency proportional to the oil flow volume. A square wave generator of conventional construction receives the frequency signal from sensor 22 and produces therefrom a square wave signal (waveform) (waveform T) having a frequency which is proportional to the frequency of the signal from sensor 22. A conventional flip-flop circuit 26 operates to produce a signal at output Q (waveform Q) which is half the frequency of the output T from square wave generator 24. Output Q from flip-flop 26 is supplied to an input terminal labelled $F_{in}$ of a frequency to voltage converter 28 which produces a direct current signal, the level of which is proportional to the frequency of signal Q.

At this point, it should be noted that the signal T from square wave generator 24 is applied through a conventional counter driver 30 to digital counters 31 and 32 for monitoring purposes. Likewise, the output signal from frequency to voltage converter 28 is applied through divider circuitry 34 to a digital panel meter capable of reading DC voltages for monitoring purposes.

The output signal from frequency to voltage converter 28 is applied by lead 35 to an operational amplifier 36 which is adjusted in the known manner to produce a maximum output of, for example, 10 volts for maximum oil flow. This voltage signal from amplifier 36 is applied directly to an input of a summing amplifier 40 via lead 37. The same output signal from amplifier 36 is applied to compensation circuit 42 which is constructed as illustrated in FIG. 2 and which in the known manner produces a signal to be applied to another input of summing amplifier 40 for introducing a signal which acts to compensate for the non-linear relationship of air flow to fan speed, i.e., a non-linear signal is added to the linear oil flow signal so that the regulation of the furnace bears a truer relationship to furnace loading.

As stated, whether the rotational speed or blade angle of fan 6 is varied, the air flow output of it does not bear a linear relationship to the operational characteristic of the fan being varied. Compensation circuit 42, in accordance with the load being experienced by the furnace, produces a non-linear signal from the signal from amplifier 36 for application to summing amplifier 40.

When oil flow is at a relatively low rate, i.e., the rotational speed of fan 6 is low, compensation circuit 42 supplies a signal which is subtracted from the oil flow signal. The signal from amplifier 36 is supplied via lead 421 and is inserted in an operational amplifier 424. Transistor 423 in this case operates as a variable resistance shunting resistor 425. When the inverted signal at terminal 422 approaches zero indicating a low oil flow rate and thereby a low value signal on 421, transistor 423 will be nonconducting and will, therefore, not shunt resistor 425. This will then produce the maximum compensation voltage on resistor 426 and at buffer amplifier 427. When the oil flow increases, the signal value on lead 421 will also increase thereby decreasing the output from operational amplifier 424. Transistor 423 then begins to conduct, shunting resistance 425 and reducing the value of the voltage signal appearing on resistor 426 toward zero. Thus, the compensation signal decreases as the oil flow to the furnace increases.

The remaining input signal to summing amplifier 40 is a signal which corresponds to the oxygen content of the flue exhaust gases. The circuitry by which this signal is produced is discussed in greater detail hereinbelow in connection with FIGS. 3 and 4.

The summing amplifier 40 which receives input signals having levels corresponding to oil flow and to the oxygen content of flue gasses, as well as a compensation signal as discussed above, produces an output which is the algebraic sum of those signals, which output is applied to an inverter amplifier 44. The inverted sum signal is coupled via lead 45 to a starting relay 46. The closed starting relay couples the inverted sum signal to a buffer stage 48 including buffer amplifier 49. The output from buffer amplifier 49 operates an analog volt meter 47 for monitoring the signal levels at this point in the circuit. The signal from buffer amplifier 49 is, as shown in the drawings, communicated to the motor speed control 19 which in turn regulates the speed of operation of fan motor 7.

As shown in FIG. 2, an oxygen sensor 12 supplies an output signal having an amplitude proportional to the oxygen content of the flue gas to an oxygen analysis unit 13 which in this case produces a zero to 20 milliamp output signal corresponding in value to the amount of oxygen found in the flue gases. The latter signal is coupled to oxygen regulator circuit 50 which produces the oxygen content input signal for summing amplifier 40.

Figure 3:
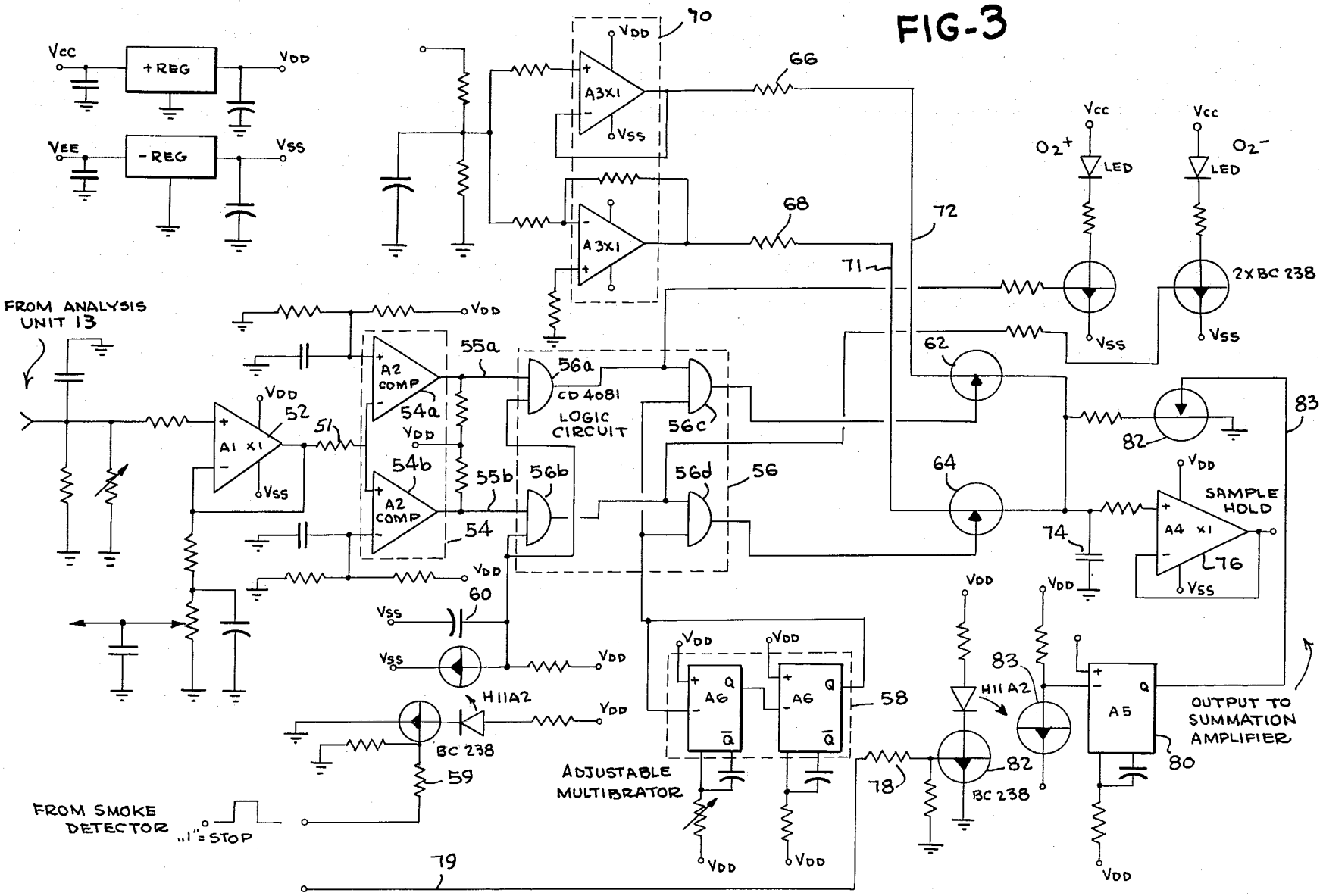
FIG. 3 is a detailed schematic diagram of oxygen regulator circuit 50 in the FIG. 2 embodiment.

FIG. 3 describes in greater detail the oxygen regulator circuit 50.

The aforementioned oxygen content signal is an important means by which fine adjustment of the rotational speed of fan motor 17 occurs. As stated, this signal is applied through summing amplifier 40 and in effect acts to vary the oil flow signal in accordance with the currently existing air characteristics.

As mentioned hereinabove, oxygen analysis unit 13 produces a current signal which corresponds to the oxygen content of the exhaust gases from the furnace. As shown in FIG. 3, this signal from analysis unit 13 is applied through lead 51 to an operational current amplifier 52. A "window" comparator 54 constructed as shown in FIG. 3 receives the output signal from amplifier 52 and compares the level of that signal with predetermined upper and lower levels in comparator amplifiers **54*a* and 54*b***.

If the signal from amplifier 52 is located within the limits of the "window" area the outputs on leads **55*a* and 55*b* will be low, whereas a signal from amplifier 52** located outside the window area will produce a high output from one of the amplifiers in the window comparator.

The output signal from window comparator 54 is applied to a logic circuit 656 constructed as shown in FIG. 3 which includes four AND gates **56*a–d*. This logic circuit is supplied, as well, with signals from an astable multivrator 58 and a signal from a capacitor 60 which is of a low value when resistor 59 receives a high valued (stop) signal from a smoke detector 84, 86 corresponding to dark smoke (see FIG. 2). The aforementioned smoke detector is described in greater detail hereinbelow in connection with FIG. 4**.

The instant window comparator 54 receives a signal which is outside the window area one of the analog switches 62 or 64, which are field effect transistors, will be supplied with a high valued signal from the logic circuit 56. Such a signal can be so supplied when the smoke detector gives a low value signal corresponding to light smoke. When one of the analog switches is operated, it will have the effect of supplying either positive or negative charge via either resistor 66 or resistor 68 to a holding capacitor 74, and this charge is applied to an input of amplifier 76. An output signal thereby produced by amplifier 76 is maintained by means of the capacitor 74 after the astable multivibrator 58 has, via logic circuit 56, turned off the previously operated analog switch. The output from amplifier 76 is then applied as the oxygen content signal to the appropriate input of summing amplifier 40 as discussed hereinabove in connection with FIG. 2.

When starting operation of the furnace, the oxygen regulation is switched off for about 20 seconds by means of a signal which is applied on lead 79 to resistor 78. This then operates analog switch 82, in the form of a field effect transistor, and the signal so initiated is coupled by means of an optical coupler 83 to monostable circuit 80 which goes high for approximately 20 seconds, and thus, turns on analog switch 82, by means of which the capacitor 74 is discharged to zero so that no oxygen regulation is at that time communicated to summing amplifier 40.

Figure 4A:
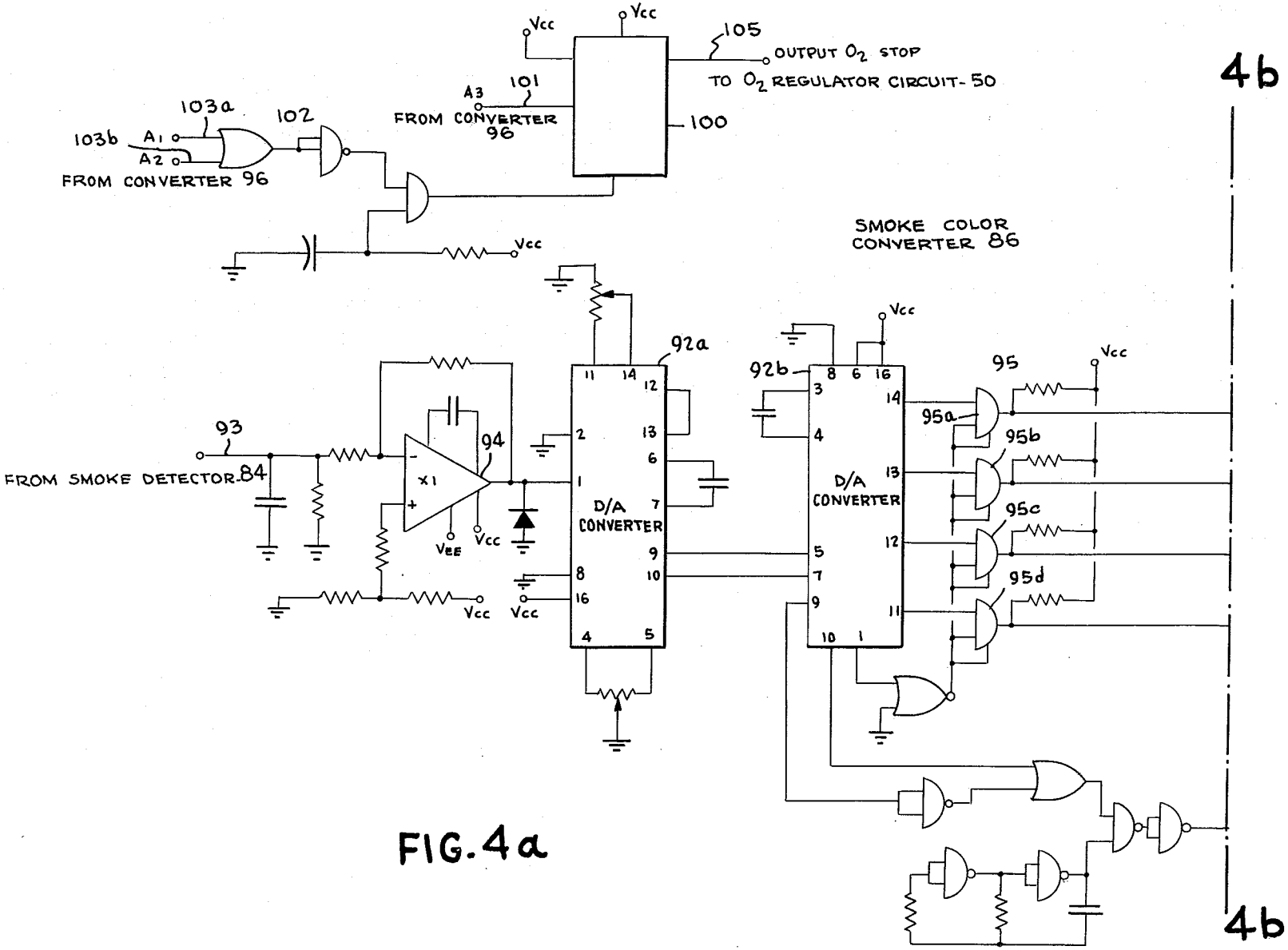
FIGS. 4*a* and *b*, viewed together, are a detailed schematic diagram of smoke color converter circuit 86 in the FIG. 2 embodiment
Figure 4B:
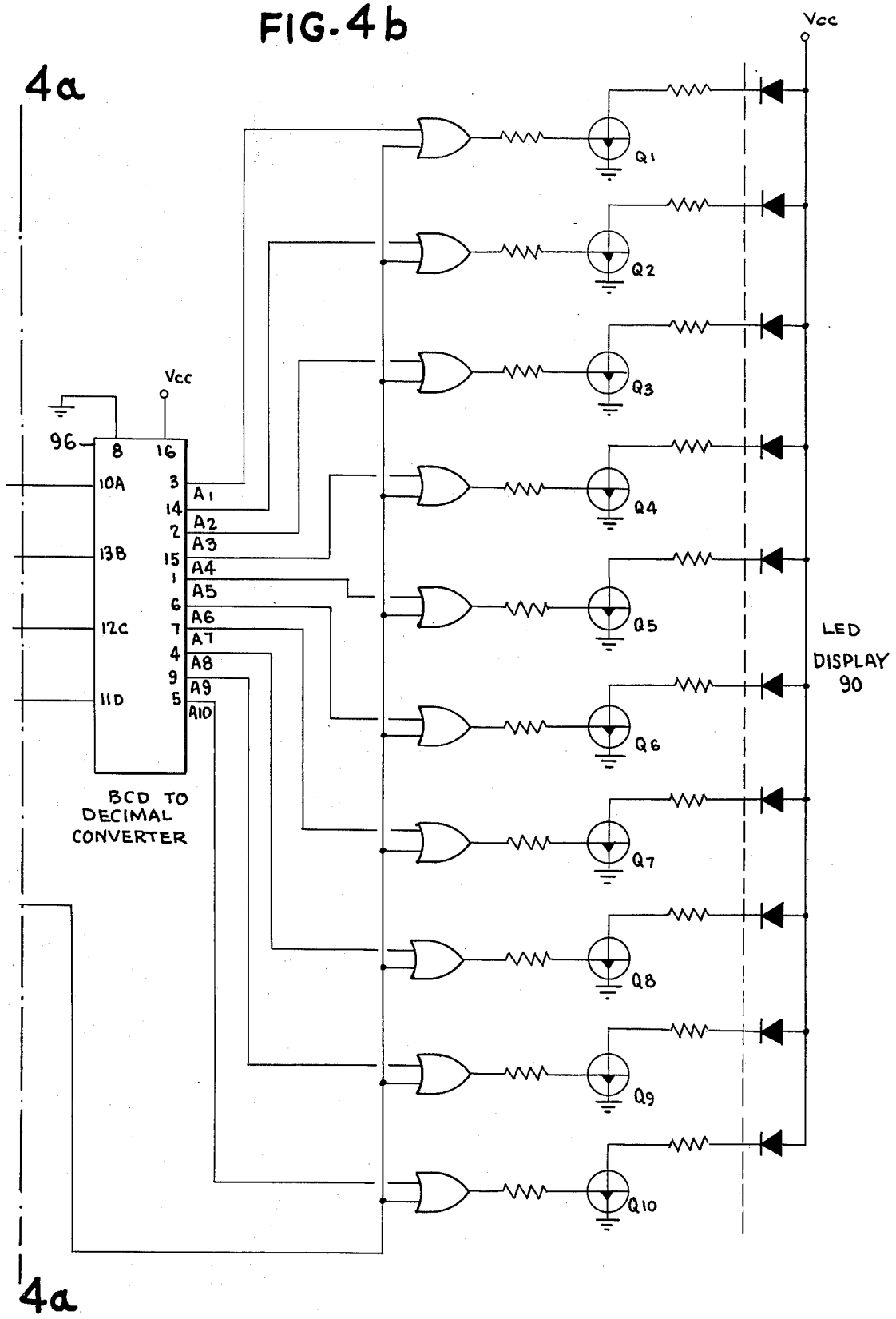

FIG. 4 is constituted by FIGS. **4*a* and *b* which are to be viewed together with FIG. 4*a* on the left; this Figure provides a detailed illustration of the smoke color converter circuit 86 schematically illustrated in FIG. 2**.

Smoke detector 84 which is a known device, produces a signal having a value of from zero to 20 milliamps in accordance with the lightness or darkness of the smoke expelled from the furnace. This signal is coupled to smoke color converter 86 via lead 93 where it is applied to an operational amplifier 94. The output from operational amplifier 94 is applied to input 1 of a digital analog converter 92 constructed from integrated circuits **92*a* and 92*b* which in the preferred embodiment have, respectively, type designations MC1405L and MC14435FL. The signal from the smoke detector is thereby converted from an analog signal to a binary coded digital (BCD) signal. This BCD signal is applied through logic circuit 95 constructed of the AND gates 95***a–d* to a BCD to decimal converter 96 which may be an integrated circuit having a type designation MC14028BCP. The latter converter operates to change the binary coded decimal signal corresponding to the smoke color signal to a decimal signal so that the value of that signal is now represented by a decimal number formed by signal apperances on various ones of the outputs A1 through A10. As these outputs are activated, they in turn activate corresponding ones of light emitting diodes in LED display 90 to provide a visual indication of the smoke characteristic.

The A1 and A2 outputs of converter 96, which correspond with the two least significant digits, are coupled to a reset input on the D-flip-flop 100, and the A3 output from converter 96 is coupled to a clock input of flip-flop 100. If the signals on A1 or A2 are high the Q output on lead 105 to oxygen regulator circuit 50 will respond with a binary 1 level. If such a signal appears, the oxygen regulation is stopped. Oxygen regulation will occur only when the output A2 at converter 96 goes high.

In addition, as shown in FIG. 5, smoke color converter 86 contains an alarm circuit which is set by operation of ones of the program switches 108. Thus, should the smoke color change to produce a predetermined output level from converter 96 the signal from the converter will be applied through the operated switch portions of the program switch 108 to a delay circuit 110 constructed as illustrated in FIG. 5. This activates an alarm of any desired type, e.g., visual or audible alarms can be used.

Due to currently prevailing environmental laws, it may be found more desirable to regulate combustion by allowing smoke color data to be the predominating regulating factor. In this situation, the embodiment described in FIGS. 3 through 5 can be easily modified in the following way.

In the FIG. 3 oxygen regulation circuit resistor 51 is connected to voltage source $V_{dd}$ rather than to the output of amplifier 52. This has the effect of supplying to window comparator 54 a signal corresponding to one which would exist if the oxygen content of the flue gasses were too high. A negative signal will then be applied via FET switch 64 to holding capacitor 74 until a "stop" signal from the smoke detector occurs. The signal from the oxygen regulator circuit 50 is then a constant value and added to the signal from compensation circuit 42 in the above described manner. In this arrangement if the smoke color becomes too dark, i.e., if the smoke detector signal is above a predetermined level holding capacitor 74 is discharged through FED 82. This has the effect of increasing the air flow for combustion by increasing fan speed. Lead 111 in FIG. 5 can be connected to lead 79 in FIG. 3. Delay circuit 110 ensures that a momentary change in smoke color does not activate monostable circuit 80. In this embodiment the delay time is selected to be two seconds.

In the description given above a complete system regulating combustion on the basis of oil flow, non-linear compensation, oxygen content and smoke color is described. For differing and perhaps less rigorous applications, simpler systems can be constructed. For example, it is possible to produce a signal from summing amplifier 40 which is only the sum of the oil flow and compensation signals. Oxygen regulation can additionally be supplied in the manner described above, but without the use of the smoke color regulation circuit. Similarly, as described immediately above the oxygen content signal can be made a constant value allowing the smoke color regulation to predominate.

It is contemplated that a number of variations can be made on the means and method disclosed herein while remaining within the scope of the invention. For example, a variety of different types of furnaces can be used, and the invention is not restricted to the use with any particular type of fuel. For example, the invention can be used with a traveling grate furnace or a furnace with a coal dust atomizer with equal success. Furthermore, as pointed out hereinabove, the carbon dioxide content of the flue gases may be monitored rather than the oxygen content to operate a circuit similar to the oxygen regulation circuit described hereinabove. The invention can generally be used without regard to the type of load being operated by the furnace. Thus, modifications or changes, such as the above, which will readily occur to one skilled in the art within the spirit and scope of the invention as defined by the appended claims.

We claim:

1. A method of controlling combustion in a furnace of a furnace system in which the rate at which fuel is supplied to the furnace is varied in accordance with the load being experienced by the furnace and the operation of a fan is regulated to vary the flow rate of combustion air supplied to the furnace, comprising the steps of:

measuring the rate at which fuel is supplied to the furnace, providing a control command on the basis of the fuel supply rate to the furnace and air and gas flow characteristics of the furnace system, and regulating operation of the fan to thereby control combustion air flow in accordance with the value of said control command.

2. The method defined in claim 1 comprising the additional steps of:

measuring the oxygen content of flue gasses exhausted from the furnace and adjusting said control command in accordance with the measured value of the oxygen content.

3. The method defined in claims 1 or 2 comprising the additional steps of:

determining the smoke color of flue gas exhausted from the furnace and adjusting said control command in accordance with the smoke color so determined.

4. A method for regulating combustion in a furnace of a furnace system in which the rate at which fuel is supplied to the furnace is varied in accordance with the load being experienced by the furnace, comprising the steps of:

supplying combustion air to the furnace by means of a continuously and infinitely variable motor driven fan, sensing the oxygen content of flue gasses expelled from the furnace and producing a first signal having a value corresponding to the oxygen content, detecting the flow rate of the fuel supply to the furnace and producing a second signal having a value corresponding to said fuel flow rate, producing a third signal having a value proportional to the value of said second signal which compensates for air and gas flow characteristics of the furnace system, adding said first, second and third signals to produce a fourth signal which is the sum of said first, second and third signals and regulating the rotational speed of said motor driven fan in accordance with the value of said fourth signal.

5. The method defined in claim 4 comprising the additional steps of:

sensing the darkness of smoke issuing from said furnace, generating a fifth signal having a value corresponding to the darkness of said smoke, and halting the production of said first signal when said fifth signal reaches a predetermined value indicating a predetermined level of smoke darkness.

6. Apparatus for regulating combustion in a furnace of a furnace system comprising:

temperature sensing means for determining the temperature in a load being heated by said furnace, fuel flow adjusting means for varying the fuel flow rate to said furnace responsive to an output from said temperature sensing means, fuel flow sensing means for producing a first signal having a value proportional to the rate of fuel flow to said furnace, flue gas sensing means for determining the amount of a given constituent in flue gasses expelled from said furnace, flue gas signal means, operable responsive to said flue gas sensing means, for producing a second signal having a value proportional to the amount of said constituent in said flue gasses, compensation circuit means for producing a third signal having a value proportional to the value of said first signal which compensates for air and gas flow characteristics of the furnace system, summing means for producing a fourth signal which is the sum said first, second and third signals, a fan driven by a motor for supplying combustion air to said furnace, a motor speed control for said fan motor for controlling the rotational velocity of said fan and means for supplying said fourth signal to said motor speed control for regulating said motor speed control and thereby the rotational velocity of said fan.

7. The apparatus defined in claim 6 further comprising:

smoke detector means for determining the darkness of smoke issuing from said furnace and generating a fifth signal having a value corresponding to the darkness of the smoke and smoke circuit means for halting the production of said first signal when said fifth signal reaches a predetermined value indicating a predetermined smoke darkness.

8. In a furnace system including a furnace in which the rate at which fuel is supplied for combustion is varied in accordance with the load being experienced by the furnace, apparatus for regulating combustion in the furnace, comprising:

blower means driven by a motor for supplying combustion air to the zone of combustion in said furnace, motor speed control means for continuously varying the speed of said fan motor responsive to a value of a control signal supplied to said motor speed control, fuel flow sensing means for producing a first electrical signal having a value proportional to the rate of fuel flow to said furnace, oxygen sensing means for monitoring flue gasses expelled from said furnace and for producing a second electrical signal having a value proportional to the oxygen content of said flue gasses, compensation circuit means for receiving said first electrical signal and producing therefrom a compensation signal which compensates for air and gas flow characteristics of the furnace system, adder means for receiving said first, second and compensation electrical signals for producing a third electrical signal which is the sum of said first, second and compensation signals, and means for supplying said third signal as said control signal to said motor speed control means.

9. The apparatus defined in claim 8 further comprising:

smoke detector means for determining the darkness of smoke issuing from said furnace and for producing a fourth electrical signal having a value corresponding to the level of darkness of the smoke and means for halting the operation of said oxygen sensing means responsive to a predetermined value of said fourth signal.

10. The apparatus defined in claim 9 further comprising:

alarm means responsive to a predetermined value of said fourth signal to provide an alarm indication of excessive darkness of smoke issuing from said furnace.

11. The apparatus defined in claim 8 wherein said oxygen sensing means further comprises:

oxygen sensor means for providing a sensor signal corresponding in value to the oxygen level in the flue gasses, comparator means for comparing said sensor signal with upper and lower reference values and for supplying a comparator output signal of a first value when said sensor signal is within the reference values and a comparator output signal of a second value when said sensor signal is without the reference values and gating means for applying a voltage of a value corresponding to the value of the comparator output signal to an output as said second signal.

12. The apparatus defined in claim 11 further comprising:

smoke detector means for generating a detector signal corresponding to the darkness of the smoke issuing from said furnace, smoke signal converter means for producing from said detector signal a fourth signal when the smoke exceeds a predetermined darkness level and means for applying said fourth signal to said gating means to block passage of said comparator output signals therethrough.

* * * * *